US005969471A

United States Patent [19]

Ozawa et al.

[11] Patent Number: 5,969,471

[45] Date of Patent: Oct. 19, 1999

[54] GRID ASSEMBLY FOR CATHODE-RAY TUBES AND METHOD OF MAKING

[75] Inventors: Lyuji Ozawa, Hopewell Jct., N.Y.; Hsien Nan Ho, Hsin chu, Taiwan; Jiin-Long Lin, Hsin-chu, Taiwan; Jen-Chau Wu, Hsin-chu, Taiwan

[73] Assignee: Industrial Technology Research Institute, Hsinchu, Taiwan

[21] Appl. No.: 08/604,477

[22] Filed: Feb. 21, 1996

[51] Int. Cl.[6] ..... H01J 29/46; H01J 29/50

[52] U.S. Cl. ..... 313/447; 313/411; 313/417; 313/450; 313/451; 313/458; 313/460

[58] Field of Search ..... 313/409, 410, 313/411, 412, 414, 441, 442, 447, 450, 452, 458, 460, 346 R, 346 DC

[56] References Cited

U.S. PATENT DOCUMENTS 5,661,363 8/1997 Iguchi et al. ..... 313/414 X 5,670,841 9/1997 Muti et al. ..... 313/450

*Primary Examiner*—Sandra O'Shea

*Assistant Examiner*—Mack Haynes

*Attorney, Agent, or Firm*—Tung & Associates

[57] ABSTRACT

A one-piece grid assembly for use in an electron gun for a miniature cathode-ray tube application that consists of a core made of an electrically insulating material, a first grid deposited on the core, and a second grid deposited on the core that is spaced apart from the first grid, and a method of making the one-piece grid assembly by first compression molding the core and then depositing the grid by plating are disclosed.

12 Claims, 2 Drawing Sheets

GRID ASSEMBLY FOR CATHODE-RAY TUBES AND METHOD OF MAKING

FIELD OF THE INVENTION

The present invention generally relates to a grid assembly for cathode-ray tubes and a method of making the grid assembly and more particularly, relates to a one-piece grid assembly that has two grids formed on a ceramic core for use in miniature cathode-ray tubes and a method of making the one-piece grid assembly.

BACKGROUND OF THE INVENTION

Cathode-ray tubes (CRT) have been used for many years for the display of information such as texts and images in the electronics industry. Two important elements to be considered when designing CRTs are the construction of the electron gun and the phosphor screen which glows when struck by an electron beam.

A basic structure of a cathode-ray tube is shown in FIG. 1. The elements that make up the section of the electron gun is shown in more detail in FIG. 2. As shown in FIG. 1, cathode-ray tube 10 is constructed of an electron gun 12, a deflection coil 14 and a screen 8 coated with phosphor particles 16 contained in a vacuum glass tube 18. A cathode 20 (shown in FIG. 2) is heated and emits a stream of electrons 22 toward the screen 8. The cathode 20 in the CRT 10, in contrast to ordinary tubes which have cathodes that emit electrons from their sides, is designed such that it emits electrons primarily from the end facing the phosphor particle coated screen 8.

As shown in FIG. 2, the cathode 20 is enclosed in a metal cylinder which acts as a control grid 24. A small opening 26 at the center of the grid 24 which faces the phosphor coated screen 8 allows the electrons 22 to pass through. The small opening 26 forces the electrons to travel in a narrow beam due to its small size. The control grid 24 is normally charged with a negative voltage with respect to the cathode 20 so that some of the electrons emitted by the cathode are not allowed to pass through the opening 26. The intensity of the electron beam 22 is therefore controlled by changing the voltage to the control grid 24 with respect to the cathode voltage and determined by the difference between the two voltages. Since the more intense of the electron beam or the larger the number of electrons striking the phosphor, the brighter the phosphor screen will glow, the brightness of the display screen can be controlled by modulating the cathode-control grid voltages.

Once the electron beam 22 passes through the small opening 26 in the control grid 24, it moves through a second grid element 28, also called a focussing grid or focussing anode. The function of the focussing grid, which has a small opening 30 to allow the electron beam to pass through, is to further tighten the stream of electrons into a finer beam.

In a conventional CRT, as that shown in FIGS. 1 and 2, an electron gun 12 is constructed of several major components, i.e., a cathode 20, a cathode support 32, grids 24, 28 and a grid spacer 34. In the manufacturing process for an electron gun, it is difficult to produce a high quality, reliable focussing gun. This is especially true in a miniature CRT where the exact alignment of the two grids is very important. A typical manufacturing process can be carried out by first metalizing the grid spacer 34, and then welding two grids 24 and 28 to the spacer. Several drawbacks are inherent in this process. First, the process is complicated and requires the use of a large number of components. Secondly, the alignment of the two grids is difficult to carry out, and thirdly, since the position of the electron gun is not fixed in the CRT, any vibration of the tube will cause the formation of distorted images.

In miniature CRTs, these problems become more severe due to the small screen size, i.e., at between 0.5 inches and 1.5 inch, and the high resolution required to display texts and images on the screen. A miniature CRT must be capable of displaying information from VGA, SVGA, as well as video texts and TV images. They are normally used in applications where the CRTs are mounted on helmets, headbands and spectacles.

It is therefore an object of the present invention to provide an electron gun for a miniature CRT and a method of making the gun.

It is another object of the present invention to provide a one-piece grid assembly for use in an electron gun for a miniature CRT and a method of making the grid assembly.

It is a further object of the present invention to provide a one-piece grid assembly for an electron gun for use in a miniature CRT that has a simplified construction and a method of making the grid assembly.

It is yet another object of the present invention to provide a one-piece grid assembly for an electron gun for use in a miniature CRT that utilizes reduced number of components and a method of making the grid assembly.

It is still another object of the present invention to provide a one-piece grid assembly for an electron gun for use in a miniature CRT that does not require alignment between two grids and a method of making the grid assembly.

It is another further object of the present invention to provide an electron gun for use in a miniature CRT that can be securely mounted to the CRT such that any vibration of the tube would not cause image distortion and a method of making the electron gun.

It is still another further object of the present invention to provide a one-piece grid assembly for an electron gun for use in a miniature CRT wherein a control grid and a focusing grid are formed on a ceramic core and a method of making the grid assembly.

It is yet another further object of the present invention to provide a one-piece grid assembly for an electron gun for use in a miniature CRT wherein the grid assembly is formed by plating metal grids on a ceramic core.

SUMMARY OF THE INVENTION

In accordance with the present invention, a one-piece grid assembly for an electron gun for use in a miniature CRT is provided.

In the preferred embodiment, the one-piece grid assembly is formed by plating on a ceramic core selected areas on the surface of the core such that two grids that are spaced apart are formed. A masking layer is used to shield the surface area on the ceramic core that separates the two grids apart. A metal pin can be molded into the center portion of the ceramic core to provide the aperture needed for the transmission of electrons. The metal pin can be etched away in an etching process after the grids are formed. Metal anchors are fitted to the outside perimeter of the ceramic core to provide anchoring of the electron gun into a CRT. The metal anchors are later fused into a glass sleeve surrounding the ceramic core in areas not covered by the metal grids. The glass sleeve provides an easy means for fusing the electron gun to the CRT glass tube such that the electron gun is securely fixed to the tube.

The present invention is further directed to a method of making a one-piece grid assembly for an electron gun for use in a miniature CRT. The grid assembly is made by first providing a ceramic core, then masking part of the surfaces of the ceramic core and plating the remaining areas to form two separate grids that are spaced apart, the masking layer is then stripped off and a glass sleeve mounting means is installed on the outer perimeter of the grid assembly such that the assembly can be permanently fused to the CRT.

BRIEF DESCRIPTION OF THE DRAWINGS

Other objects, features and advantages of the present invention will become apparent upon consideration of the specification and the appended drawings, in which.

DETAILED DESCRIPTION OF THE PREFERRED EMBODIMENT

A one-piece grid assembly for use in an electron gun for a cathode-ray tube consisting of a core made of an electrically insulating material, a first grid deposited on the core and a second grid deposited on the core that is spaced apart from the first grid is provided by the present invention. A method of making such a one-piece grid assembly by first forming the core and then depositing the grids is also disclosed.

Figure 1:
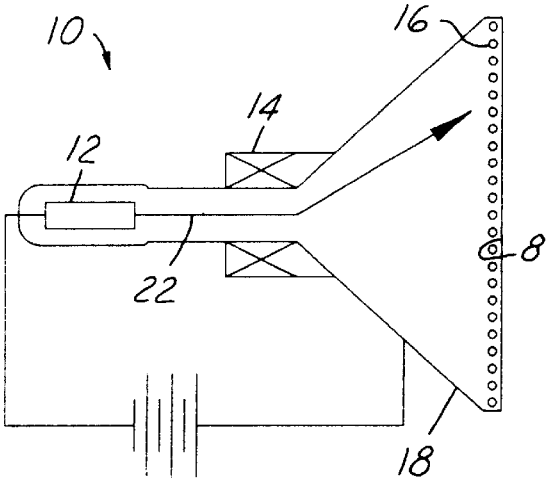
(Prior Art) FIG. 1
FIG. 1 is a schematic of a cross-sectional view of a conventional CRT.
Figure 3:
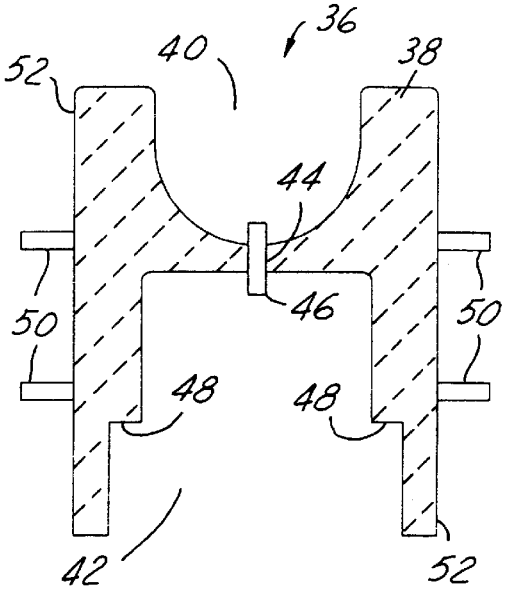
FIG. 3 is an enlarged, cross-sectional view of the present invention ceramic core for the grid assembly.

Referring initially to FIG. 3, wherein a core 36 made of an electrically insulating material is shown. The core 36 generally has an elongated cylindrical shape with a cylinder body 38 and two oppositely situated hollow ends 40 and 42. The core 36 can be formed of an electrically insulating material by a conventional compression molding method. The core may also be formed by any other known method, such as machining. A suitable material is an electronic grade aluminum oxide having approximately 90% purity. Any other suitable electrically insulating material can also be used.

During a compression molding process for the core, an aperture 44 is generally provided by a pin 46. The aperture 44 is used for the transmission of an electron beam through the grids. A suitable size of the aperture 44 is between about 0.1 mm to about 0.3 mm, even though apertures having diameters slightly deviated from these dimensions may also work in the present invention. A suitable thickness of the core 36 at the pin location is approximately between about 0.15 to about 0.3 mm. A suitable material used for pin 46 is a metal that can be subsequently etched away in an etching process. A step 48 is built into the hollow end 42 to facilitate the mounting of a cathode means. Metal anchors 50 may optionally be provided on the outer peripheral surface 52 of the core 36 to facilitate mounting of the electron gun to a CRT.

Figure 4:
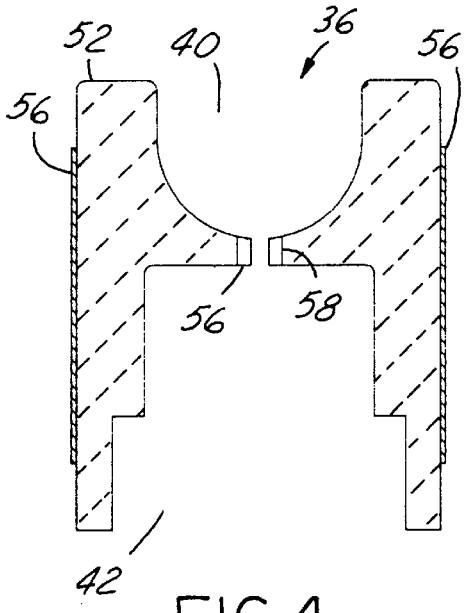
FIG. 4 is an enlarged, cross-sectional view of the ceramic core covered partially by a masking layer.

Referring now to FIG. 4 where it is shown the core 36 with a masking layer 56 partially coated on the outer peripheral surface 52 of the core 36 and the inner peripheral surface 58 of the hole 44. The masking layer 56 can be deposited on the core 36 by any one of the conventional masking techniques. A suitable material for the masking layer 56 is a polymeric material such as polyamide. The masking layer 56 covers the outer peripheral surface 52 of the core 36 and the inner peripheral surface 58 of the hole 44 that are not going to be covered by the grid.

Figure 5:
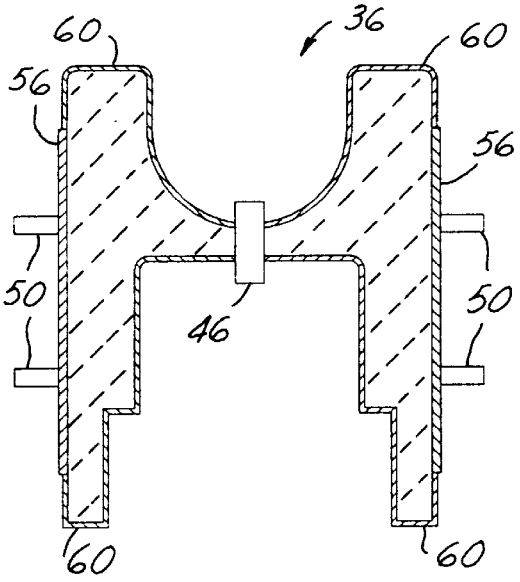
FIG. 5 is an enlarged, cross-sectional view of the ceramic core partially covered by a masking layer and plated with a metallic grid material.

After a selected surface area is covered by the masking layer 56, a metal layer 60 is deposited on core 36 by any one of known techniques such as electroplating, electroless plating, sputtering, evaporating, and chemical vapor deposition. This is shown in FIG. 5. A suitable metal material used for the metal layer 60 can be any metal that has high electrical conductivity and low electrical resistance. A suitable metal can be selected from Ni, Cr, Cu, Ag, Au, and their alloys. Other metals of high electrical conductivity may also be suitably used in the present invention.

Figure 6:
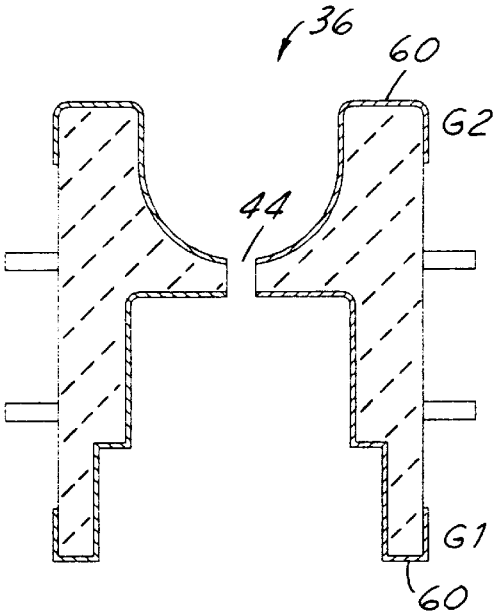
FIG. 6 is an enlarged, cross-sectional view of the ceramic core that has two metallic grids deposited thereon and the masking layer removed.

In the next processing step, as shown in FIG. 6, the masking layer 56 and the pin 46 are removed by conventional etching methods. This leaves an aperture 44 and two grids G1 and G2 formed by the metal layer 60.

Figure 7:
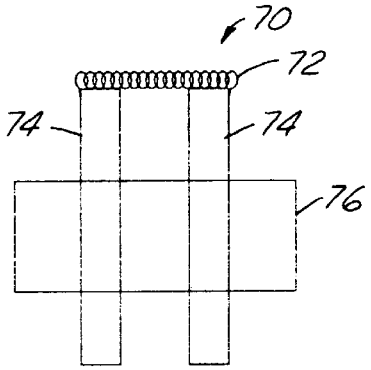
FIG. 7 is an enlarged, cross-sectional view of a cathode assembly for the present invention electron gun.

A cathode means 70 having a cathode 72 supported on two metal bars 74 and insulator 76 is shown in FIG. 7. The insulator 76 can be made of a material similar to that used in the cylinder body 38 shown in FIG. 3.

Figure 8:
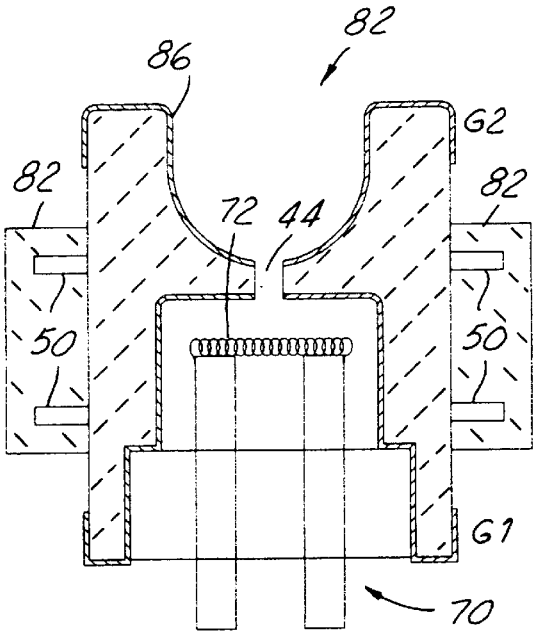
FIG. 8 is an enlarged, cross-sectional view of the present invention grid assembly that has a cathode assembly installed therein.

A completed electron gun 80 wherein the cathode means 70 is assembled to the G1 grid is shown in FIG. 8. During operation, electrons emitted from the cathode 72 passes through the aperture 44 toward the CRT screen. To facilitate the assembly of electron gun 80 to the CRT, glass sleeve 82 is provided to imbed the metal anchors 50. The outside diameter of the glass sleeve 82 is slightly smaller than the inside diameter of the elongated section of the CRT such that the glass sleeve 82 can be fused to the CRT. The cathode 72 may optionally be covered with a coating of barium oxide such that its work function is reduced to allow easier electron emission. It should be noted that the curvature 86 of the G2 grid is not critical for the electron gun 80 to function properly.

Figure 2:
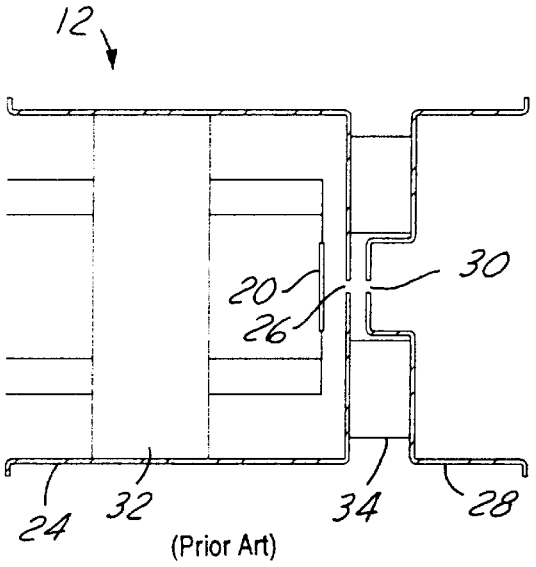
(Prior Art) FIG. 2
FIG. 2 is an enlarged, cross-sectional view of an electron gun used in a conventional miniature CRT.

The benefits achieved by the present invention one-piece grid assembly can be easily observed from FIG. 8. Grid G1 and grid G2 are permanently fixed in position to each other and spaced apart at a predetermined distance defined by the thickness of the aperture 44. The necessity of a difficult alignment process required for the conventional set-up shown in FIG. 2 is completely eliminated. As a result, a small electron beam size in the range between about 10 $\mu$m and about 20 $\mu$m can be achieved to allow the production of high resolution images.

The present invention one-piece grid assembly further reduces the number of components necessary for the assembly. There is no need for a separate spacer placed between the two grids as that shown in the conventional electron gun. Furthermore, the metal anchors 50 and the glass sleeve 82 provide an easy and secure assembly of the electron gun 80 to the CRT. No movement of the electron gun 80 relative to the CRT will occur even under severe vibrational conditions.

While the present invention has been described in an illustrative manner, it should be understood that the terminology used is intended to be in a nature of words of description rather than of limitation.

Furthermore, while the present invention has been described in terms of a preferred embodiment thereof, it is to be appreciated that those skilled in the art will readily apply these teachings to other possible variations of the invention.

The embodiments of the invention in which an exclusive property or privilege is claimed are defined as follows:

1. A one-piece grid assembly for use in an electron gun for a cathode-ray tube comprising:

a core made of an electrically insulating material, a first grid wrapped around a first end of said core, and a second grid wrapped around a second end of said core opposite to said first end, said second grid being spaced apart from said first grid.

2. A one-piece grid assembly according to claim 1, wherein said first and said second grid have a thickness of not less than 2 microns.

3. A one-piece grid assembly according to claim 1, wherein said first and said second grid are formed of a metal selected from the group consisting of Ni, Cu, Cr, Ag, Au and alloys thereof.

4. A one-piece grid assembly according to claim 1, wherein said first and said second grid are formed by a technique selected from the group consisting of electroplating, electroless plating, sputtering, evaporating and chemical vapor deposition.

5. A one-piece grid assembly according to claim 1, wherein said assembly having an aperture formed through said first grid, said second grid and said core.

6. A one-piece grid assembly according to claim 5 wherein said aperture having a diameter of not larger than 0.4 mm.

7. A one-piece grid assembly according to claim 1, wherein said core having an elongated cylindrical shape and two oppositely situated hollow ends.

8. A one-piece grid assembly according to claim 7, wherein said first and said second grid are formed at least partially in said two oppositely situated hollow ends.

9. A one-piece grid assembly according to claim 7, wherein one of said two oppositely situated hollow ends is provided to accommodate a cathode means.

10. An electron gun for use in a cathode-ray tube comprising:

a core made of an electrically insulating material, a first grid wrapped around a first end of said core, a second grid wrapped around a second end of said core opposite to said first end, said second grid being spaced apart from said first grid, and a cathode means situated in one of said first and said second grid.

11. An electron gun according to claim 10, wherein said core having an elongated cylindrical shape and two oppositely situated hollow ends with one of said hollow ends adapted to accommodate said cathode means.

12. An electron gun according to claim 10, wherein said first and said second grid are formed of a metal selected from the group consisting of Ni, Cu, Cr, Ag, Au and alloys thereof to a thickness of not less than 2 microns.

* * * * *